US006179673B1

(12) United States Patent
Leroux

(10) Patent No.: US 6,179,673 B1
(45) Date of Patent: Jan. 30, 2001

(54) OUTBOARD MOTOR PROTECTION APPARATUS

(76) Inventor: Raymond A. Leroux, 2 Dunelm Drive, St. Catharines, Ontario (CA), L2M 4A1

( * ) Notice: Under 35 U.S.C. 154(b), the term of this patent shall be extended for 0 days.

(21) Appl. No.: 09/516,244

(22) Filed: Mar. 1, 2000

(51) Int. Cl.[7] ..... B63H 20/08

(52) U.S. Cl. ..... 440/65; 440/71

(58) Field of Search ..... 440/53, 56, 65, 440/71

(56) References Cited

U.S. PATENT DOCUMENTS 2,135,907 * 11/1938 Miller ..... 440/65
2,713,843 * 7/1955 Staley ..... 440/65
2,972,977 * 2/1961 Hausmann ..... 440/65

* cited by examiner

*Primary Examiner*—Jesus D. Sotelo

(57) ABSTRACT

An outboard motor protection apparatus is interposable between an outboard motor and a transom of a boat. The mounting of the motor on the transom of the boat is such as to allow for pivotal movement of the motor relative to the transom, about a first substantially horizontal tilt axis, between a drive configuration and a raised configuration. The apparatus comprises a mount for removably mounting it onto the transom of the boat with a base plate extending downwardly in juxtaposed relation to a trailing face of the transom. A leg of the apparatus is operatively positioned in leadingly adjacent relation to a skeg portion of the outboard motor. The leg is mounted adjacent an upper end thereof on the base plate for its pivotal movement, in a plane substantially transverse to the base plate about a second substantially horizontal tilt axis, between a rest position, whereat a longitudinal axis of the leg is substantially vertically disposed, and a plurality of active positions, whereat the longitudinal axis is removed from the rest position and the leg is in operative contact with the motor. When the leg encounters an underwater obstruction as a result of the forward motion of the boat through a body of water, the leg pivotally moves as aforesaid so as to cause a pivotal movement of the motor from the drive to the raised configuration. In this manner, the outboard motor avoids impact with the underwater obstruction so as to be protected from damage through such impact.

21 Claims, 12 Drawing Sheets

OUTBOARD MOTOR PROTECTION APPARATUS

FIELD OF THE INVENTION

The present invention relates to the field of outboard motor boat accessories and more particularly to a device removably interposable between an outboard motor and a transom of a boat upon which the outboard motor is to be mounted, such that the outboard motor is protected by the device from damage upon the boat encountering an underwater obstacle during its movement through a natural body of water.

BACKGROUND AND SUMMARY OF THE INVENTION

In the prior art, there have been numerous safety tilt mechanisms for limiting the potential damage experienced by outboard motors upon the boat encountering an underwater obstacle, such as a rock or log, during movement of the boat through a natural body of water. However, these mechanisms usually require that the outboard motor collide with an underwater obstacle directly and receive the impact of that collision in order for the outboard motor to be caused to tilt. Examples of such prior art mechanisms can be seen in, for example, U.S. Pat. Nos. 3,470,844; 3,570,443; 3,577,954; 3,648,645; 3,722,456; 3,859,952; and 3,952,687.

It is common knowledge that outboard motors are expensive pieces of equipment. As such, it is highly undesirable for an outboard motor to collide with an obstacle directly and receive the impact of that collision, since such impacts invariably result in a certain degree of damage being inflicted upon the outboard motor. Such damage may be to the mechanism for mounting the motor onto the boat, to the propeller, to one of the components of the propeller mounting housing protruding below the water line, or to the internal drive components mounted within the propeller mounting housing. Even the transom of a boat may be damaged in severe impact situations.

Heretofore, designs aimed at avoiding damaging contact of outboard motors with underwater obstacles have remained substantially undeveloped. However, notable attempts in this regard are the complex hull and transom altering designs disclosed by U.S. Pat. No. 5,238,432 (Renner). This patent relates to a Marine Drive Unit Impact Avoidance System, a device which, upon the impact arm of the invention encountering an underwater obstruction, provides for the drive unit to be lifted in a substantially vertical plane to clear the obstruction without any direct contact of the motor drive unit and the underwater obstruction. Renner broadly teaches a marine device unit impact avoidance system for boats of both the outboard and inboard/outboard types, which device is comprised, in the preferred embodiment disclosed, of two principal components, the first being an impact activating arm, pivotally mounted at one end to the bottom of the boat hull and at its opposite other end to the lower drive unit of the boat motor. The second main component of the preferred embodiment disclosed by Renner is comprised of a vertically moveable mounting means, which is adapted to have the boat motor mounted thereon so as to allow the motor to vertically slide, against the resistance of shock absorbers, upon an upwardly directed force generated by the impact activating arm hitting a rock, or other underwater obstruction. Both the impact activating arm and the motor mounting means are permanently mounted on the boat in a manner that prohibits the device from being readily transferred from one boat to another.

A secondary embodiment taught by the Renner patent is of more relevance to the present invention. In this embodiment, the device of the disclosed invention is shown in use with a conventional outboard motor, and is configured for mounting on the transom of the boat. That is, both of the two main components discussed above, being in this embodiment the engine mounting member and the impact activating arm, are mounted on the transom of the boat by way of a single base plate member. The motor in this embodiment also moves in a substantially vertical plane upon encountering a submerged obstacle as the boat progresses forwardly, and again, this alternate embodiment of the Renner patent is not readily interchangeable from one boat to another, as it requires breach of the transom's integrity and permanent modification to both the transom of the boat and to the housing of the motor. Thus, it not only lacks portability and interchangeability, but it is relatively complicated, expensive, and difficult to install. In addition, in both of the embodiments taught by the Renner patent, a boat is required to be physically removed from the water in order to perform the modifications necessary for mounting the device onto the boat.

It is a general object of the present invention to provide an outboard motor protection apparatus that protects an outboard motor from potentially damaging impact with underwater obstructions during passage of the boat through a body of water and, by reason of its relatively simple construction, overcomes the shortcomings of the prior art.

It is a further general object of the present invention to provide an outboard motor protection apparatus that can be quickly and easily installed and removed from a boat in situ, without breaching the integrity of the hull or transom of the boat and without requiring permanent modification to be made to such a boat.

It is yet another object of the present invention to provide an outboard motor protection apparatus that can be quickly and readily mounted and unmounted from the transom of a boat for use with an outboard motor without the use of hand tools or other subsidiary equipment.

It is a still further object of the present invention to provide an outboard motor protection apparatus that will not scratch or cause other incidental damage to the transom of a boat as a result of its installation thereon, use therewith, or removal therefrom.

It is an object of the present invention to provide an outboard motor protection apparatus that is preferably adjustable to various depths to protect the outboard motor from direct impact with obstacles located a varying depths below the surface of the water through which a boat moves.

It is another object of an alternate embodiment of the present invention to provide an outboard motor protection apparatus that will assist in preventing the propeller of an outboard motor from becoming entangled with underwater weeds.

There is thus provided, according to one aspect of the present invention, an outboard motor protection apparatus removably interposable between an outboard motor and a transom of a boat upon which the outboard motor is to be mounted. The outboard motor is of a conventional type having a downwardly depending propeller mounting housing terminating in a skeg portion. The mounting of the outboard motor on the transom of a boat is such as to allow for pivotal movement of the motor relative to the transom, about a first substantially horizontal tilt axis, between a drive configuration and a raised configuration. The outboard motor protection apparatus of the invention comprises means for removably mounting the apparatus onto the transom of the boat, with a base plate member extending downwardly in juxtaposed relation to a trailing face of the transom, and a leg member. The leg member has an upper end portion and a lower end portion, defining a longitudinal leg axis extending therebetween. The leg member is operatively positioned in leadingly adjacent relation to the skeg portion of the outboard motor, and it is mounted adjacent its upper end portion on the base plate member for pivotal movement of the leg member in a plane substantially transverse to the base plate member, about a second substantially horizontal tilt axis. The leg member moves pivotally between a rest position, whereat the leg axis is substantially vertically disposed, and a plurality of active positions, whereat the leg axis is removed from the rest position so as to place the leg member in operative contact with the outboard motor. The positioning and mounting of the leg member is such that, when it encounters an underwater obstruction as a result of the boat's forward motion through a body of water, it moves from the rest position to one of the plurality of active positions so as to cause the pivotal movement of the outboard motor from the drive configuration to the raised configuration. In this manner, the outboard motor avoids direct impact with the underwater obstruction, so as to be protected from damage through such impact.

In a preferred embodiment, the outboard motor protection apparatus is adapted to be removably mounted in overhanging relation over the transom of the boat. The means for removably mounting the apparatus onto the transom of the boat comprises an inverted "U"-shaped hook portion having a first arm formed by an upper extent of the base plate member, and a second arm formed by a downwardly projecting lip member. The lip member is connected to the first arm by a flange member adapted to overlie an upper free edge of the transom. The lip member is bifurcated to form two discrete laterally spaced lip member portions. The flange member and the lip member portions are together dimensioned and otherwise adapted to allow mounting clamps of the outboard motor to bear directly upon a leading face of the transom of the boat when the outboard motor is mounted upon the boat.

According to a further aspect of the invention, the bearing surfaces of the base plate member, the flange member, and the lip member portions, being those underside surfaces contacting the transom of the boat, preferably have a resilient cushioning layer applied thereover constructed from synthetic rubber. This synthetic rubber coating protects the transom from scratching and other incidental damage that might otherwise be caused by installing, using, or removing the outboard motor protection apparatus and lessens vibration that might otherwise be transferred from the base plate to the transom of the boat.

According to another aspect of the present invention, the leg member preferably has a horizontally disposed vortex blocking flange positioned in substantially surrounding relation thereto. This vortex blocking flange is located at a level on the leg member so as to be below the surface of the water when the apparatus is mounted on the transom of the boat in the manner indicated above, and the leg member is in its rest position. The vortex blocking flange act to assist in preventing the formation of whirlpools centered around the leg member as the leg passes through the water upon forward motion of the boat.

According to a further aspect of the invention the preferred embodiment further comprises a resilient strap member and a bumper member, having a motor mounting surface and a leg contact surface. The bumper member is removably mountable on the propeller mounting housing of the outboard motor in interposed relation between the outboard motor and the leg member when in use. Such mounting of the bumper member on the propeller mounting housing allows the bumper member to present its leg contact surface as a locus for controlled operative contact with the leg member upon the pivotal movement of the leg member from the rest position, as aforesaid. The bumper member preferably comprises a horizontally disposed finned portion which projects leadingly forward, in partially surrounding, non-contacting relation to the leg member, in its rest position. The resilient strap member is preferably connected to the bumper member at either end of its motor mounting surface so as to stretch over a trailing surface of the propeller mounting housing of the outboard motor, when the bumper member is mounted on the downwardly depending propeller mounting housing. The leg contact surface of the bumper member is preferably V-shaped.

According to another aspect of the invention, the upper end portion of the leg member is preferably formed by a discrete upper end segment, and the lower end portion of the leg member is preferably formed by a discrete lower end segment. The upper end and lower end segments are interconnected to one another by means of one or more discretely formed intermediate leg segments slidably mounted one within the other. An uppermost of the intermediate leg segments is slidably mounted within the upper end segment, and the lower end segment is slidably mounted within a lowermost of the intermediate leg segments. Taken together, the upper end segment, one or more of the intermediate leg segments, and the lower end segment form a telescopic leg member assembly.

According to yet a further aspect of the present invention, the outboard motor protection apparatus preferably further comprises a biasing means, such as a coil spring, interconnected between the upper and lower end segments of the leg member so as to bias the telescopic leg member toward a fully extended configuration.

According to a further aspect of the present invention, the outboard motor protection apparatus preferably further comprises a retracting means for controlled retraction of the lower end segment relative to the intermediate leg segments and the upper end segment of the telescopic leg member, against biasing by the biasing means. The retracting means preferably comprises a Bowden cable, and a control means. The Bowden cable of the retracting means has a first and a second end, the first end of which is operatively connected within the leg member to the lower end segment. The control means of the retracting means comprises a control handle, operatively connected to the second end of the Bowden cable, and a notched control panel which accepts the control handle in a plurality of different positions. As a result of the Bowden cable running between the control handle and the lower end segment of the leg member, each of the plurality of different positions of the control handle on the notched control panel corresponds to a different amount of retraction of the lower end segment of the leg member. In this manner, the outboard motor protection apparatus is adjustable to various depths, and is thereby able to protect the outboard motor from direct impact with obstacles located at varying depths below the surface of the water through which the boat is moving.

According to yet another aspect of the invention, the upper end segment, the intermediate leg segments, and the lower end segment are each preferably constructed from a non-resilient, rigid plastics material. Also preferably constructed of a non-resilient, rigid plastics material are the base plate member, the flange member, and the lip member portions. The bumper member is preferably constructed from a resilient plastics material having shock absorption qualities selected from the group consisting of rubber, synthetic rubber, nylon, and filled nylon.

The alternate embodiment of the invention differs from the preferred embodiment in that there is provided a leg member of constant length that reaches to a level below the skeg portion of the outboard motor, at which level two weed cutting blades are connected to the lower end portion. The two weed cutting blades operatively extend, one each, in opposite lateral directions toward a port side and a starboard side of the boat, in substantially horizontal, generally transverse axial relation to the longitudinal leg axis.

Other objects, advantages, features and characteristics of the present invention, as well as methods of operation and functions of the related elements of the structure, and the combination of parts and economies of manufacture, will become more apparent upon consideration of the following detailed description and the appended claims, with reference to the accompanying drawings, the latter of which is briefly described hereinbelow.

DETAILED DESCRIPTION OF A PREFERRED EMBODIMENT

Figure 1:
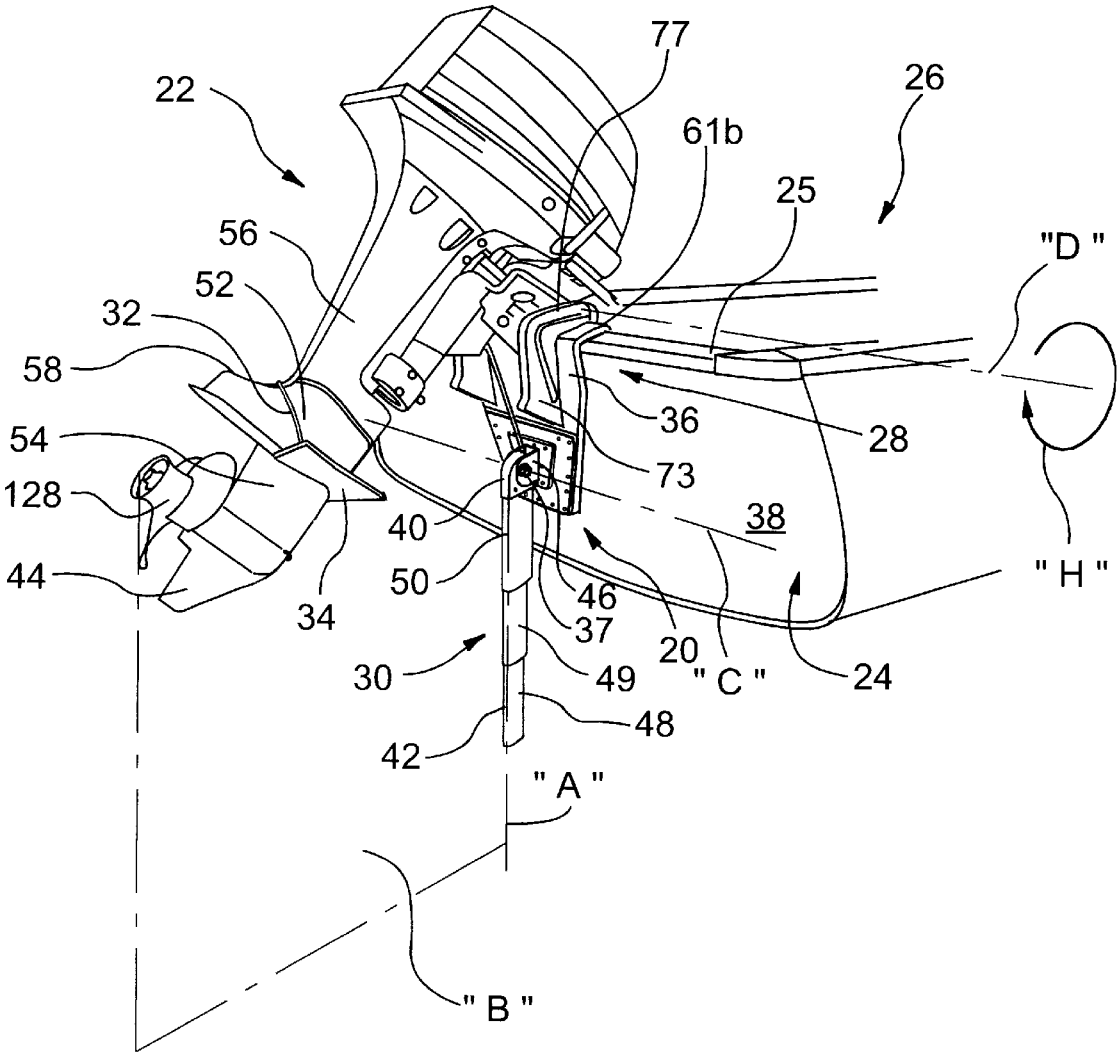
FIG. 1 is a rear starboard side perspective view of a preferred embodiment of an outboard motor protection apparatus according to the invention interposed between an outboard motor and the transom of a boat, with the leg member shown in a rest position and the outboard motor shown in a raised configuration for ease of illustration.

FIG. 1 shows a preferred embodiment of an outboard motor protection apparatus 20 interposed between an outboard motor 22 and a transom 24 of a boat 26. The outboard motor protection apparatus 20 comprises means 28 for removably mounting the apparatus 20 onto the transom 24 of the boat 26, a leg member 30, an optional resilient strap member 32, and an optional bumper member 34. The mounting means 28 comprises a base plate member 36 extending downwardly in juxtaposed relation to a trailing face 38 of the transom 24. The leg member 30 has an upper end portion 40 and a lower end portion 42, defining a longitudinal leg axis "A" extending therebetween. The leg member 30 is shown in FIG. 1 in a rest position. The term "rest position" means, in this specification and claims, a position of the leg member 30 whereat the longitudinal leg axis "A" is substantially vertically disposed. The leg member 30 is mounted adjacent its upper end portion 40, by way of a pivot pin 37, on the base plate member 36 for pivotal movement of the leg member 30 in a plane "B" substantially transverse to the base plate member 36, about a substantially horizontal tilt axis "C", which axis is coincident with a longitudinal axis of the pivot pin 37. The pivot pin 37 is, in turn, mounted between ears of a bifurcated mounting bracket 46 affixed to the base plate member 36.

As shown in FIGS. 1 through 13, the lower end portion 42 of the leg member 30 is preferably formed by a discrete lower end segment 48, and the upper end portion 40 of the leg member 30 is preferably formed by a discrete upper end segment 50. The upper end segment 50 and the lower end segment 48 are preferably interconnected by a discretely formed intermediate leg segment 49, with the intermediate leg segment 49 being slidably mounted within the upper end segment 50, and with the lower end segment 48 being slidably mounted within the intermediate leg segment 49, thereby to together form a telescopic leg member assembly 51. From FIG. 6, it will be noted that the leg member 30 further preferably comprises a biasing means, namely, a coil spring 88, positioned within the telescopic leg member assembly 51, between a lower 87 and an upper 89 holding plate, which coil spring 88 act to bias the lower end segment 48 toward a fully extended configuration of the telescopic leg member assembly 51. The term "fully extended configuration" means, in this specification and claims, the position whereat both an annular lower stop lip 69*a* of the upper end segment 50 and an annular lower stop lip 69*b* of the intermediate leg segment 49 are, respectively, in immediate downwardly adjacent relation to a corresponding upper stop lip 70*a* of the intermediate leg segment 49 and to a corresponding upper stop lip 70*b* of the lower end segment 48. In this manner, the lower stop lip 69*a* on the upper end segment 50 and the upper stop lip 70*a* on the intermediate leg segment 49 act as limit means to prevent the individual leg segments 50, 49 from slidably extending relative to each other beyond the fully extended configuration seen in FIG. 6. The positioning and mounting of lower stop lip 69*b* on the intermediate leg segment 49 and upper stop lip 70*b* on the lower end segment 48 similarly act as limit means to prevent the individual leg segments 49, 48 from slidably extending relative to each other beyond the fully extended configuration (also seen in FIG. 6).

The outboard motor 22 is of a conventional design, having a downwardly depending propeller mounting housing 56 terminating in a skeg portion 44. The mounting of the outboard motor 22 on the transom 24 of the boat 26 is also in a conventional manner, which allows for pivotal movement of the motor 22 relative to the transom 24 in a direction depicted by arrow "H" of FIG. 1 about a substantially horizontal tilt axis "D", between a drive configuration (as shown in, for example, FIG. 3) and a raised configuration (as shown in, for example, FIG. 4). In the drive configuration, as shown in FIGS. 3, 8, 10, 11, 12, and 13, it will be noted that the propeller mounting housing 56 is substantially vertically disposed, so that a propeller 128 of the outboard motor 22 is operatively disposed within a body of water 74 to most efficiently drive the boat 26 in a forward direction depicted by arrow "E" of FIG. 3. The term "raised configuration", as shown, for example, in FIGS. 1, 4, and 5, represents any one of a plurality of positions that is not the drive configuration and in which the outboard motor 22 is pivotally tilted in the direction of arrow "H" about the horizontal tilt axis "D" (as seen in FIG. 1), such that the propeller 128 faces upwardly from its most efficient drive orientation, thereby to impart a significant drive force vector on the transom 24 in a downward direction, as seen in the Figures. In order to allow the pivotal movement of the outboard motor 22 in the direction of arrow "H", the outboard motor 22 must not be locked in a particular trim position about its substantially horizontal tilt axis "D", as is common practice in the conventional operation of an outboard motor 22; that is, the motor 22 must be allowed to pivotally move freely about the tilt axis "D" in the direction of arrow "H" between its drive configuration and a plurality of raised configurations upon the boat 26 encountering an underwater obstruction 72 with the apparatus 20 of the invention in place on the transom 24. In FIG. 1, the outboard motor 22 is shown in the raised configuration for ease of illustration, only.

The optional bumper member 34 is preferably positioned on the outboard motor 22 between a drive shaft portion 52 and a gear case portion 54 of the propeller mounting housing 56 of the outboard motor 22. The optional resilient strap member 32, being, for example, a resilient neoprene rubber strap, or a bungee cord, is connected at each of its opposite ends to holes (not shown) in the bumper member 34, and stretches over a trailing surface 58 of the drive shaft portion 52 of the outboard motor 22 to hold the bumper member 34 in place on the propeller mounting housing 56, as illustrated.

Figure 11:
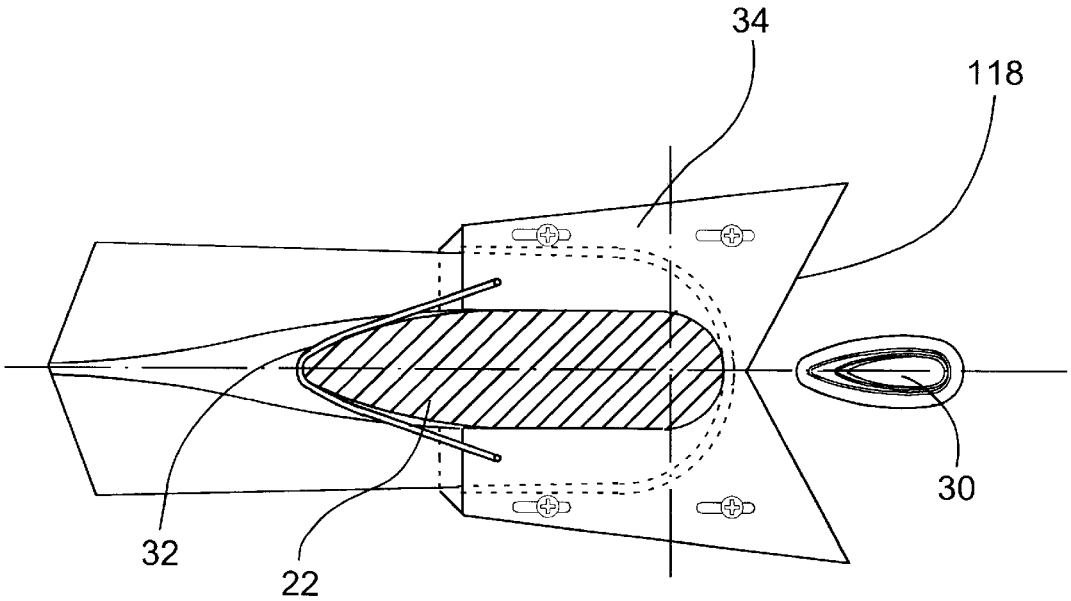
FIG. 11 is a sectional view along sight line 11—11 of FIG. 10.
Figure 12:
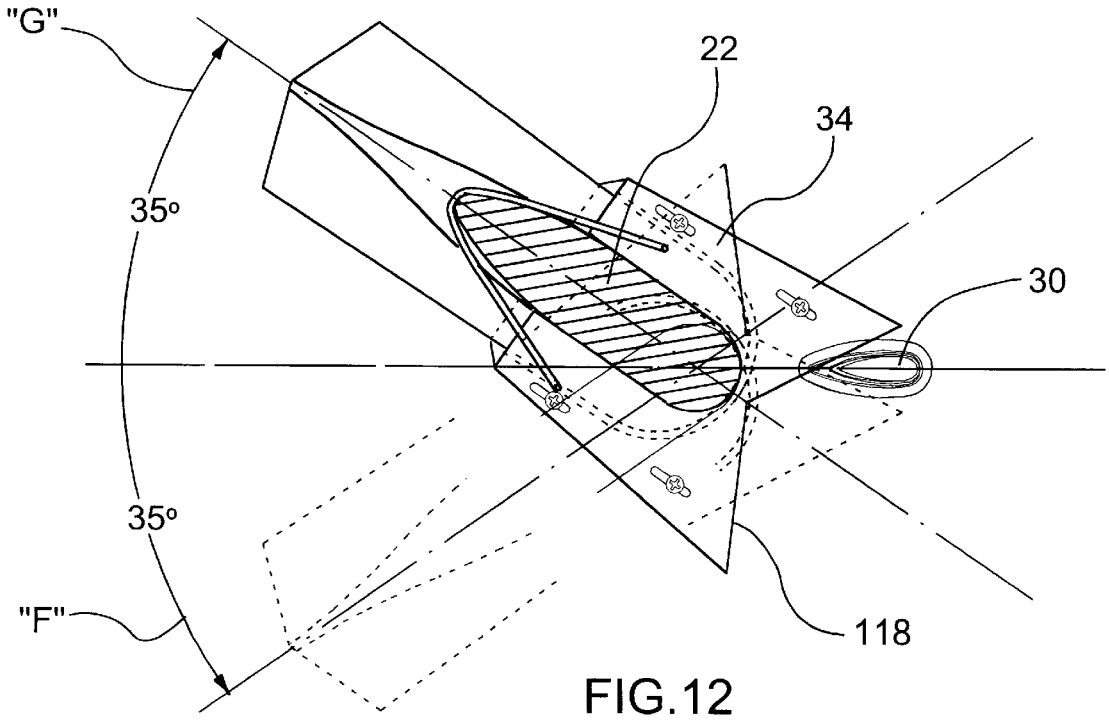
FIG. 12 is a sectional view, similar to FIG. 11 showing, in solid outline, the outboard motor turned fully toward a port side of the boat and, in phantom outline, turned fully toward a starboard side of the boat.

As can be seen from FIGS. 11 and 12, a leg contact surface 118 of the bumper member 34 is preferably substantially "V"-shaped, in plan outline. The bumper member 34 is preferably dimensioned and otherwise adapted to allow the sides of its "V"-shaped leg contact surface 118 to clear the leg member 30 when the bumper member 34 is mounted on the outboard motor 22 and the outboard motor 22 is turned fully toward either a starboard side (as indicated by arrow "F" of FIG. 12) or a port side (as indicated by arrow "G" of FIG. 12) during steering maneuvers of the boat 26. Conventionally, such full steering movements entail turning the outboard motor 22 approximately 35 degrees to the starboard or to the port side of the boat 26, as indicated by the "35°" legends in FIG. 12. In FIGS. 11 and 12, a cross-section of the leg member 30 is also shown, revealing a preferable streamlined sectional shape for this member 30.

Figure 13:
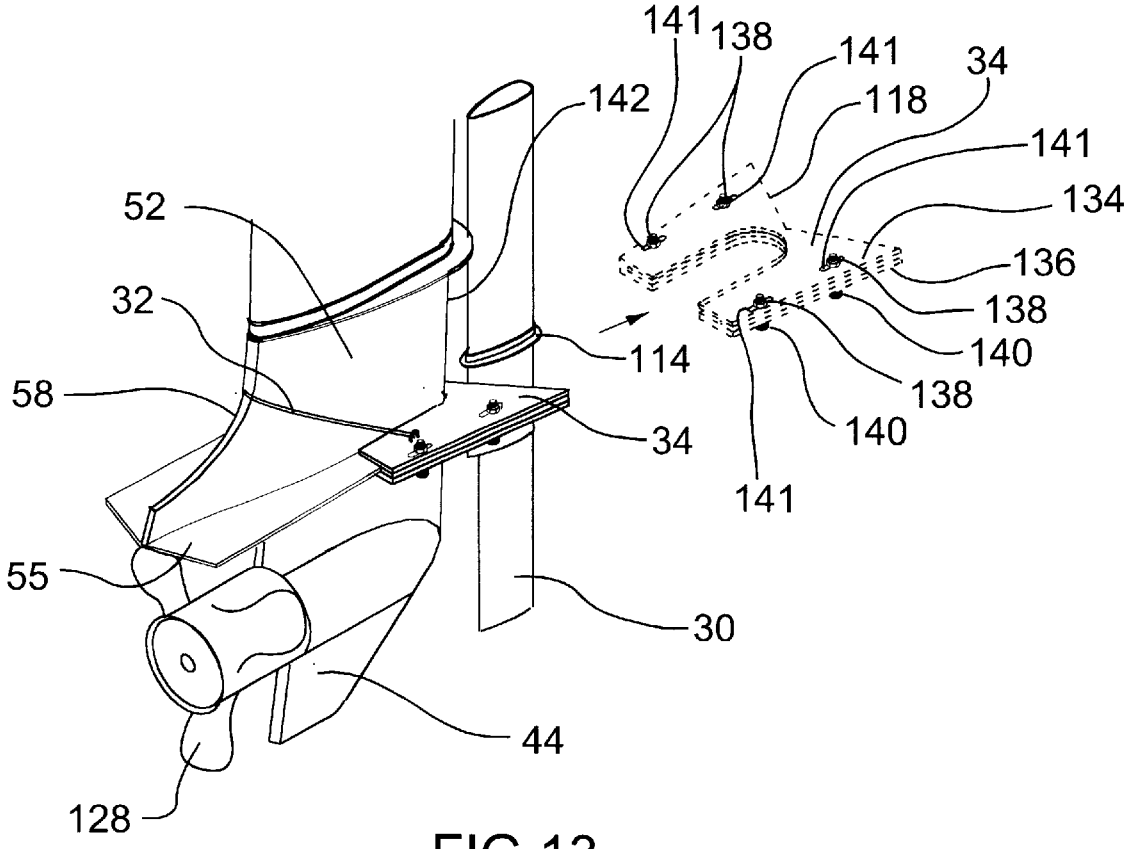
FIG. 13 is a rear starboard side perspective view of the encircled area 13 of FIG. 8, additionally showing, in phantom outline, the bumper member removed from the propeller mounting housing of the outboard motor.
Figure 14:
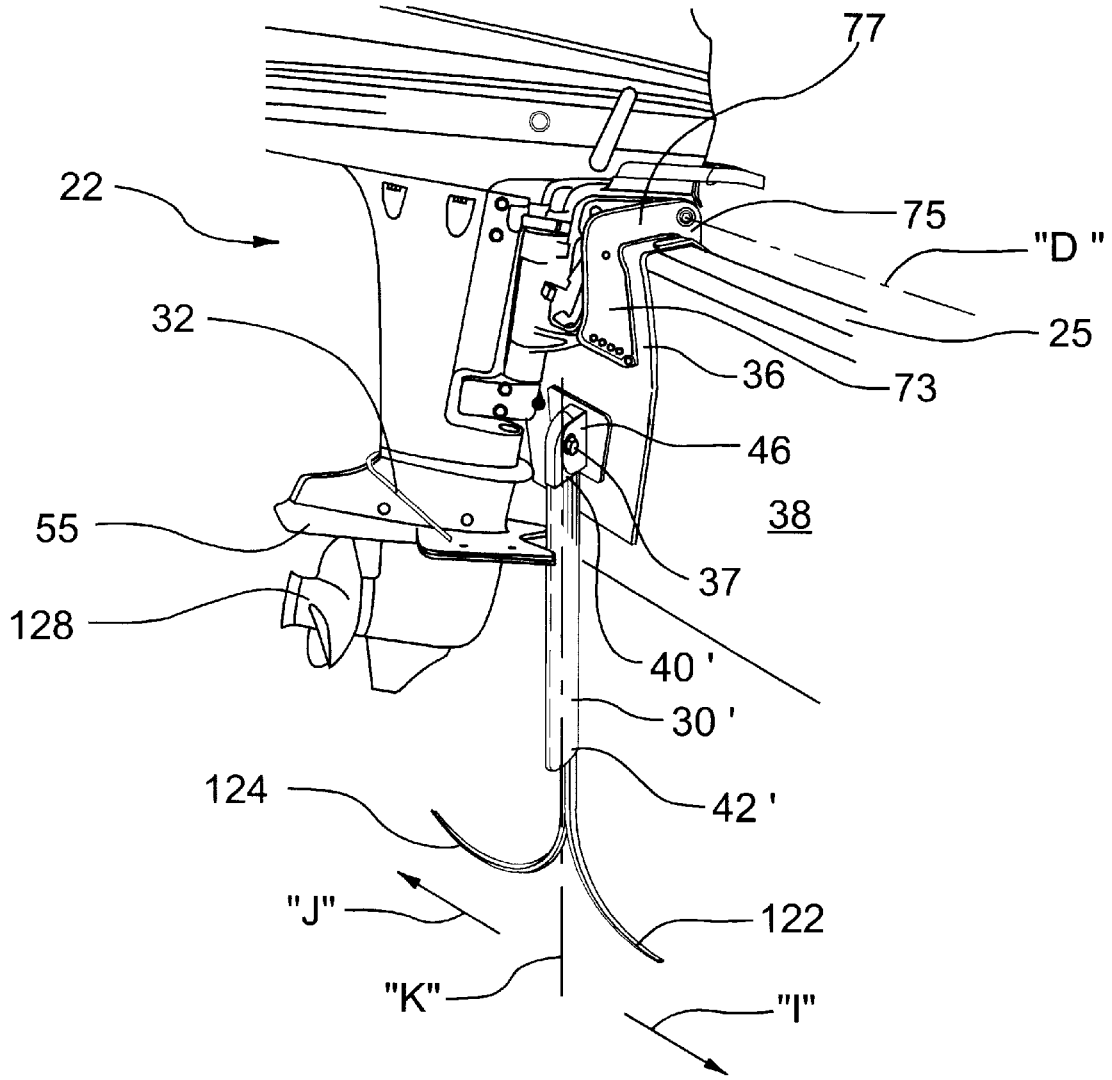
FIG. 14 is a partial rear starboard side perspective view of an alternate embodiment of an outboard motor protection apparatus according to the invention, interposed between an outboard motor and the transom of a boat, wherein the alternate leg member is in its rest position and comprises two laterally extending weed cutting blades, and wherein the outboard motor is in a drive configuration, but turned toward a port side of the boat for ease of illustration.
Figure 15:
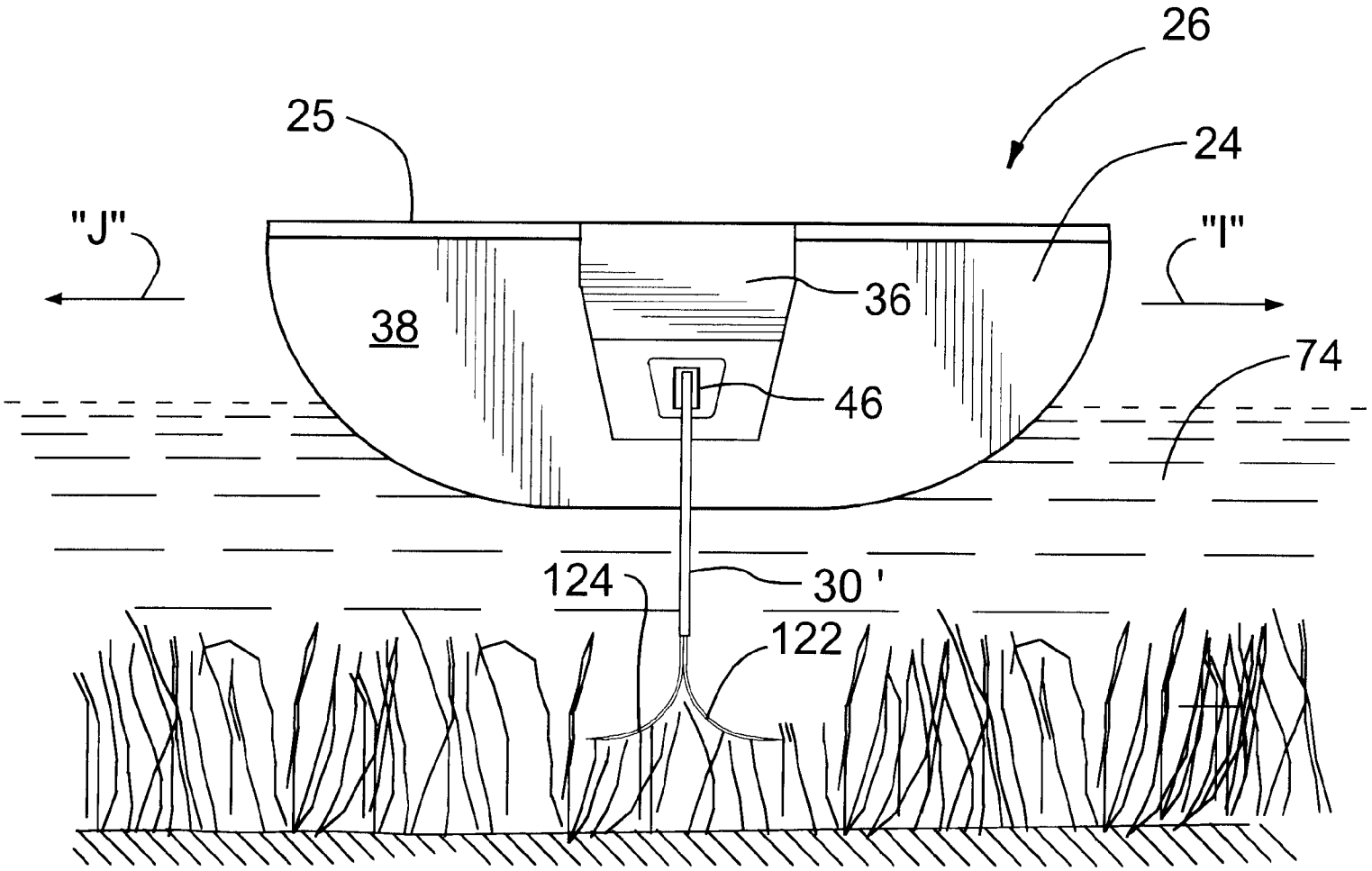
FIG. 15 is a rear elevational view of the alternate embodiment of FIG. 14, with the outboard motor removed for ease of illustration.

Referring now to FIG. 13, it will be noted that the bumper member 34 also has a motor mounting surface 116, in addition to the aforementioned leg contact surface 118. The motor mounting surface 116 is generally "U"-shaped in outline, and is dimensioned to fit snugly against a leading face 142 and in side surfaces of the drive shaft portion 52 of the propeller mounting housing 56. In greater detail than as aforesaid, FIG. 13 shows that the resilient strap member 32 is connected to the bumper member 34 adjacent either end of the motor mounting surface 116, and stretches therebetween over the trailing surface 58 of the drive shaft portion 52 of the outboard motor 22. Further, the bumper member 34 will be seen to preferably comprise an upper bumper plate portion 134 and a lower bumper plate portion 136, joined together in sliding relation to one another by way of four nuts 138 and four bolts 140 interacting with respective alignable slots 141 formed in each plate portion 134, 136. The four slots 141 formed in each of the upper 134 and lower 136 bumper plate portions are dimensioned and otherwise adapted to allow the upper bumper plate portion 134 to be joined in selectively adjustable sliding relation with the lower bumper plate portion 136 in a range of aligned configurations corresponding to different degrees of forward reach. In this manner, the upper bumper plate portion 134 can be slid forwardly relative to the lower bumper plate portion 136 (i.e., in the direction of arrow "E" of FIGS. 3 and 4) upon installation of the bumper member 34, so as to adjust the operative clearance between the leg contact surface 118 and the leg member 30 in the rest position for optimum results with the particular boat/motor combination with which the apparatus 20 is being used. It will be seen from FIG. 13, that it is desirable to mount the bumper member 34 with a horizontal fin member 55, formed on the drive shaft portion 56 of most outboard motors 22, sandwiched between the upper 134 and the lower 136 bumper plate portions, thereby to impart added stability to such a mounting arrangement.

FIG. 13 also shows that the preferred embodiment further comprises a horizontally disposed vortex blocking flange 114 positioned on the leg member 30 in substantially surrounding relation thereto, so as to be positioned below the surface of the water 74 when the apparatus 20 is mounted on the transom 24 of the boat 26 and the leg member 30 is in its rest position. The vortex blocking flange 114 is also positioned on the leg member 30 so as to be in immediate upwardly adjacent relation to the bumper member 34, when in use, and when the bumper member 34 is mounted on the outboard motor 22. The aforementioned dimensioning and positioning of the vortex blocking flange 114 is designed to assist in preventing the formation of whirlpool eddies flowing in a circular direction about the leg member 30, as the boat 26 pulls the leg member 30 through the water 74 in the forward direction of arrow "E". It is desirable to prevent the formation of such eddies, since their presence can lead to a "wash-out" of the propeller, being an inability of the propeller 128 to provide sufficient forward driving force as a result of excess air in the fluid mixture in which the propeller 128 is immersed while driving. By providing a generally horizontally disposed barrier to block a downward moving vertical column of air alongside the moving leg member 30, the vortex blocking flange 114 assists in preventing the formation of such whirlpool eddies.

Figure 2:
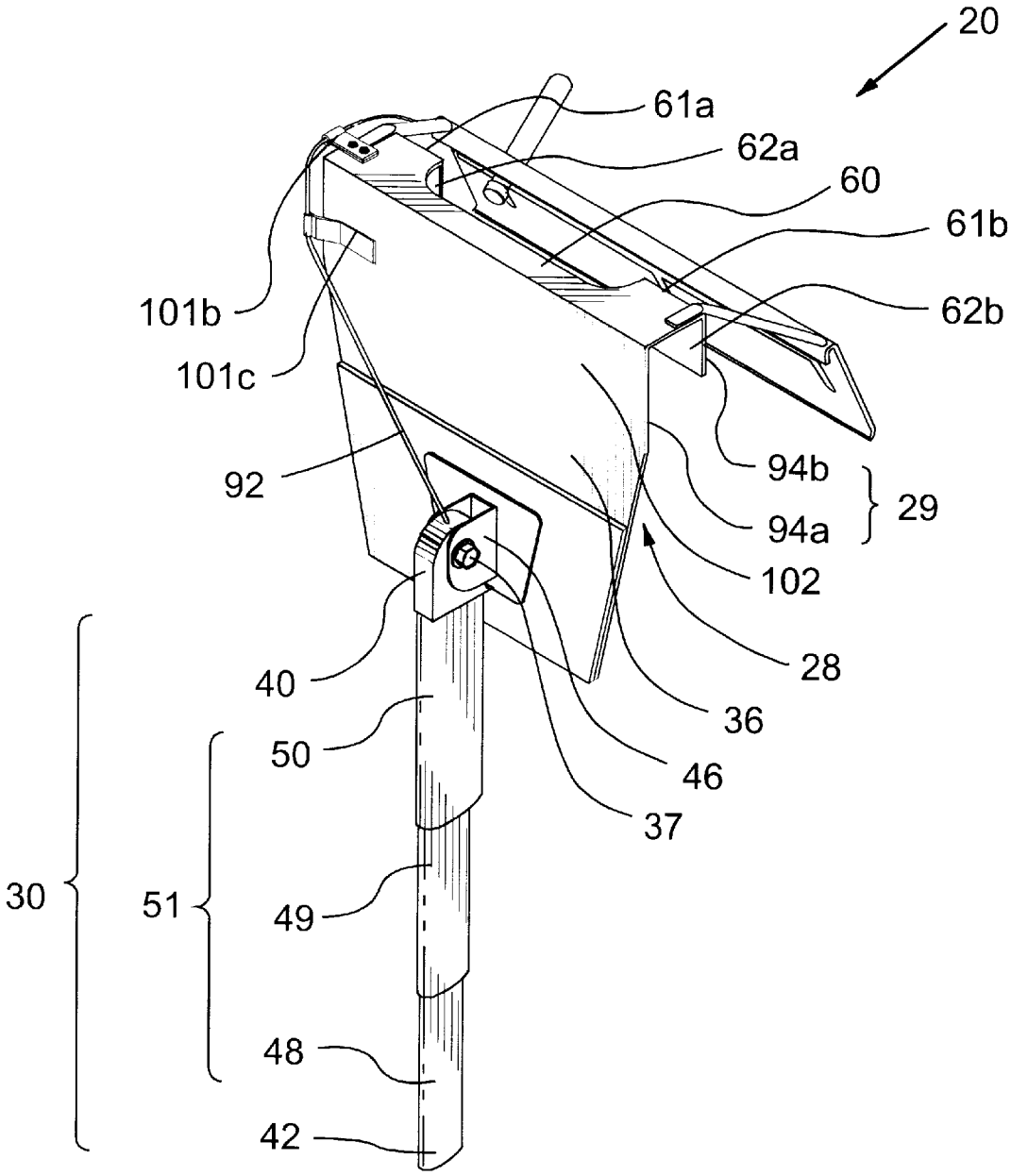
FIG. 2 is a rear starboard side perspective view of the outboard motor protection apparatus of FIG. 1 shown removed from the boat and the outboard motor.
Figure 6:
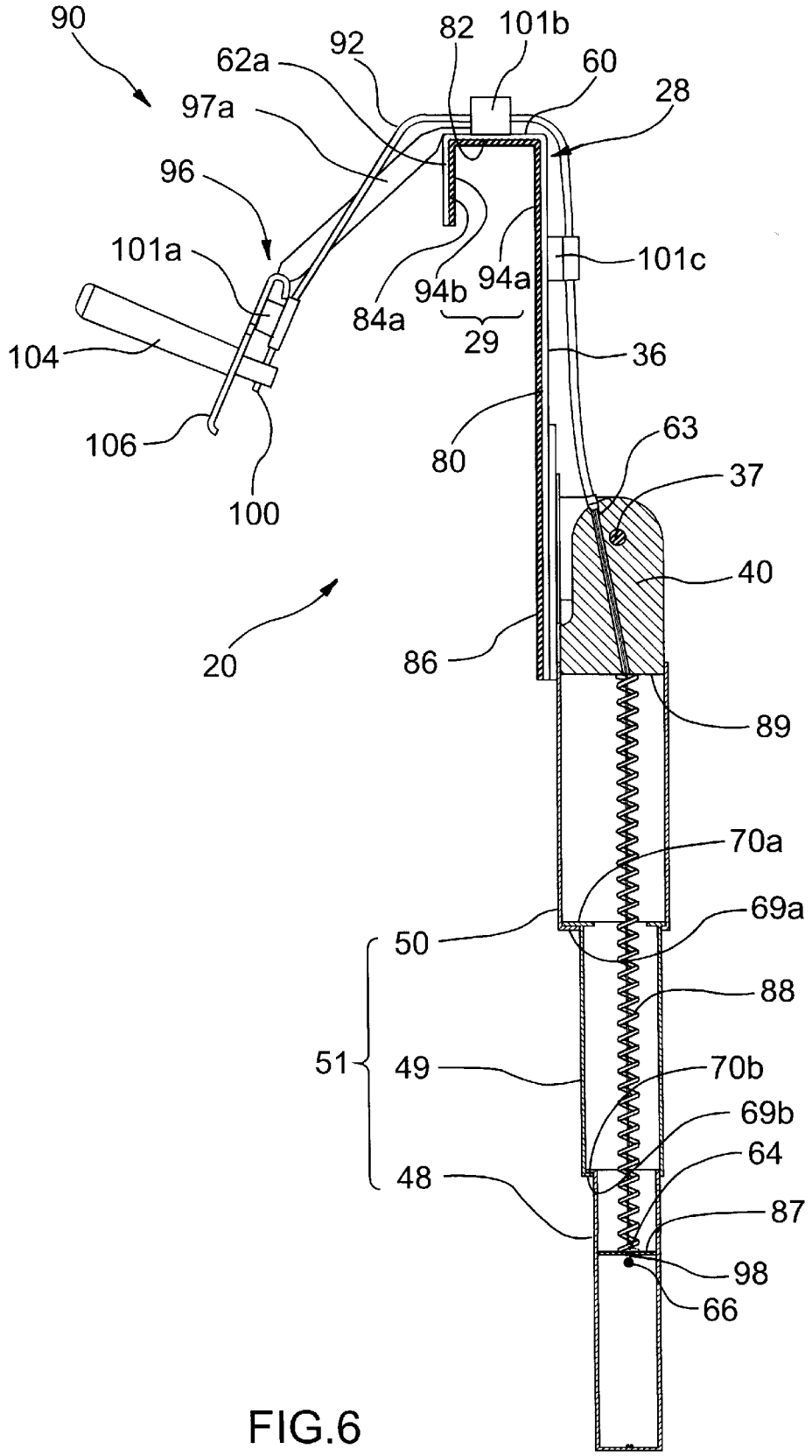
FIG. 6 is a port side elevational view of the apparatus of FIG. 2, with the telescopic leg member assembly sectioned to show its interior components.

Turning to FIGS. 2 and 6, the mounting means 28 of the preferred embodiment can be seen to further comprise a generally "C"-shaped flange member 60 (when seen in plan view), and two discrete laterally spaced lip member portions 62*a* and 62*b*. The flange member 60 extends in substantially perpendicular and horizontal relation from an upper extent 102 of the base plate member 36, while the two lip member portions 62*a* and 62*b* each extend in substantially perpendicular, downwardly directed relation from bifurcated leading edges 61*a* and 61*b* of the respective arms of the "C"-shaped flange member 60. Taken together, the base plate member 36, the flange member 60, and the lip member portions 62*a* and 62*b* comprise an inverted, generally "U"-shaped, hook portion 29 of the mounting means 28 (best seen in FIG. 6), having a first arm 94*a* formed by an upper extent is 102 of the base plate member 36, and a second arm 94*b* compositely formed by the downwardly projecting lip members 62*a* and 62*b*. In this manner, the mounting means 28 is adapted to mount the apparatus 20 on the transom 24 of the boat 26 in overhanging relation thereto, with the flange member 60 adapted to overlie an upper free edge 25 of the transom 24.

Figure 7:
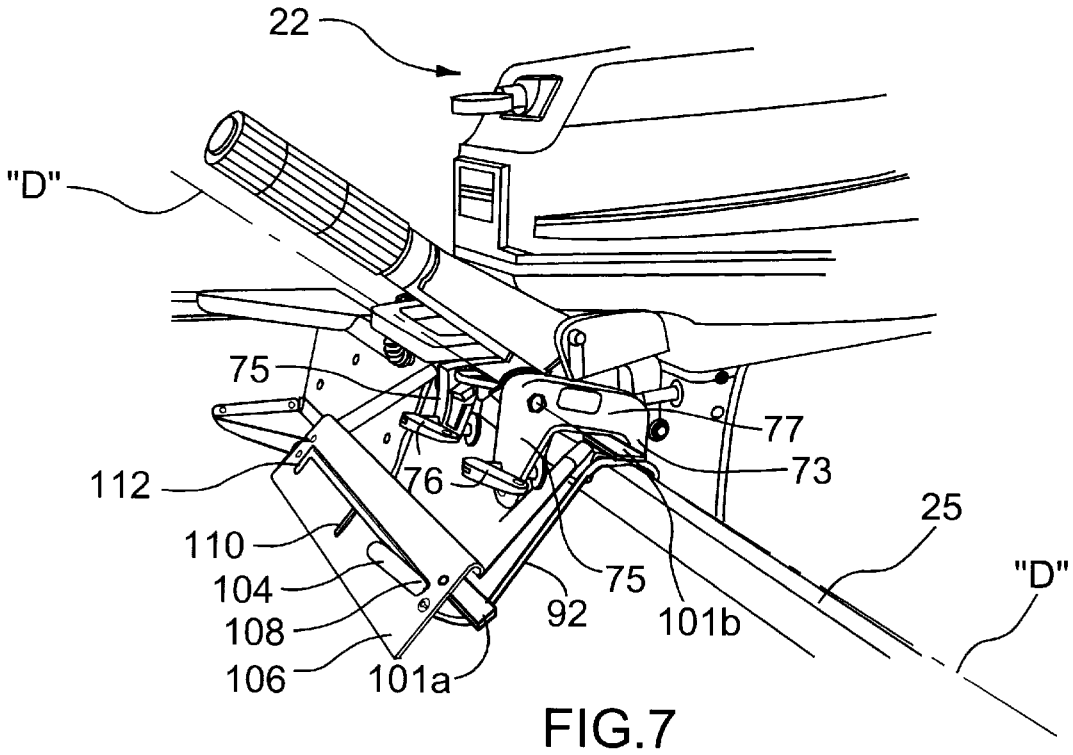
FIG. 7 is a front port side perspective view of the preferred embodiment of FIG. 3 showing the control handle positioned in the leg down notch.

Both the "C"-shaped flange member 60, with its bifurcated leading edges 61*a* and 61*b*, and the lip member portions 62*a* and 62*b* respectively connected thereto are preferably dimensioned and otherwise adapted so as to allow two forwardly directed parallel arms 75 of two conventional "C"-shaped motor mounting brackets 77 of the outboard motor 22 to fit therebetween, and to allow two respective mounting clamps 76, screw-threaded into such arms 75, to bear directly upon a leading face 78 of the transom 24, as best seen in FIGS. 5 and 7. Two rearwardly directed arms 73, extending one each from the two "C"-shaped motor mounting brackets 77, are in frictional contact with the base plate member 36. In this manner, the outboard motor 22 is securely mounted on the boat 26 in a conventional manner, with the outboard motor protection apparatus 20 interposed therebetween.

Turning to FIG. 6, it will be noted that bearing surfaces 80, 82, and 84*a* of the base plate member 36, the flange member 60, and the lip member portion 62*a* respectively (and also, a bearing surface 84*b* of the lip member portion 62*b*, which surface 84*b* and portion 62*b* are not visible in FIG. 6, but are mirror images of 84*a* and 62*a* respectively), being those surfaces for making contact with the transom 24 of the boat 26 during use, preferably have a resilient cushioning layer 86 applied thereover, which cushioning layer 86 is preferably constructed from, for example, synthetic rubber. In use, the inherent characteristics of this synthetic rubber resilient cushioning layer 86 are such as to assist in protecting the transom 24 from scratching and other incidental damage that might otherwise be caused by installing, using, or removing the outboard motor protection apparatus 20.

Figure 8:
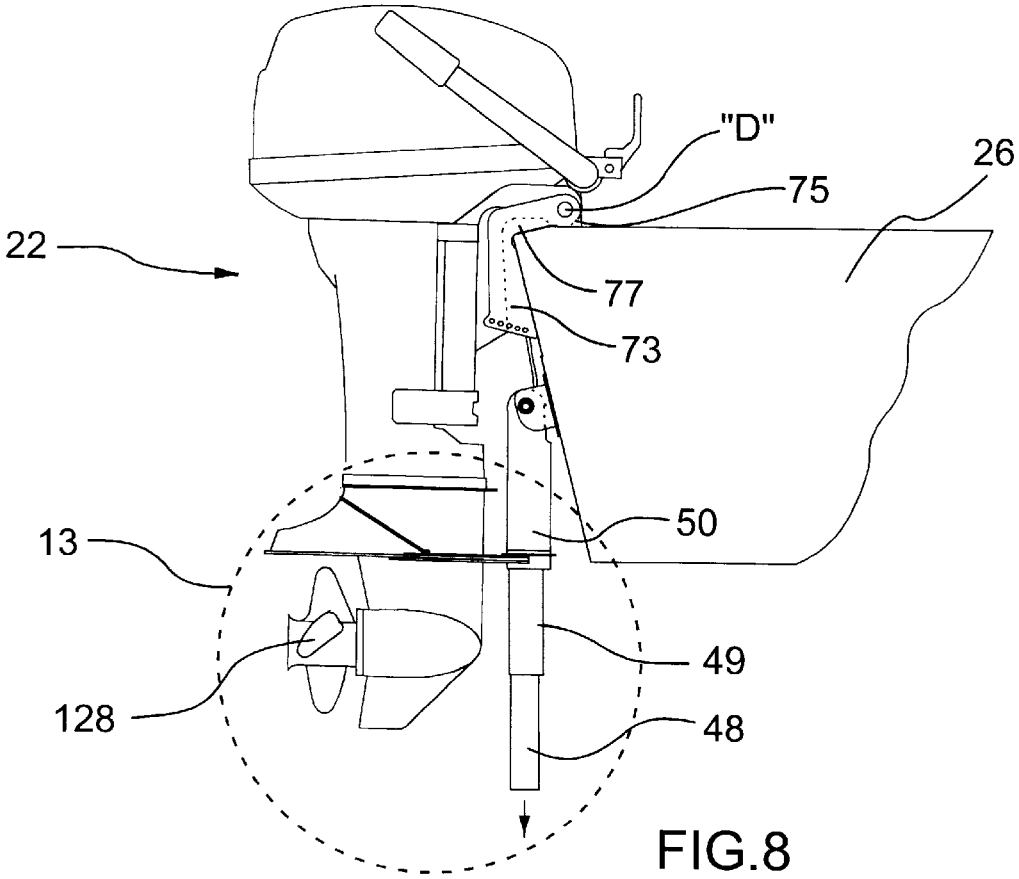
FIG. 8 is an enlarged scale starboard side elevational view of a stern a section of the outboard motor and the boat of FIG. 3, showing the telescopic leg member assembly in its fully extended configuration.
Figure 9:
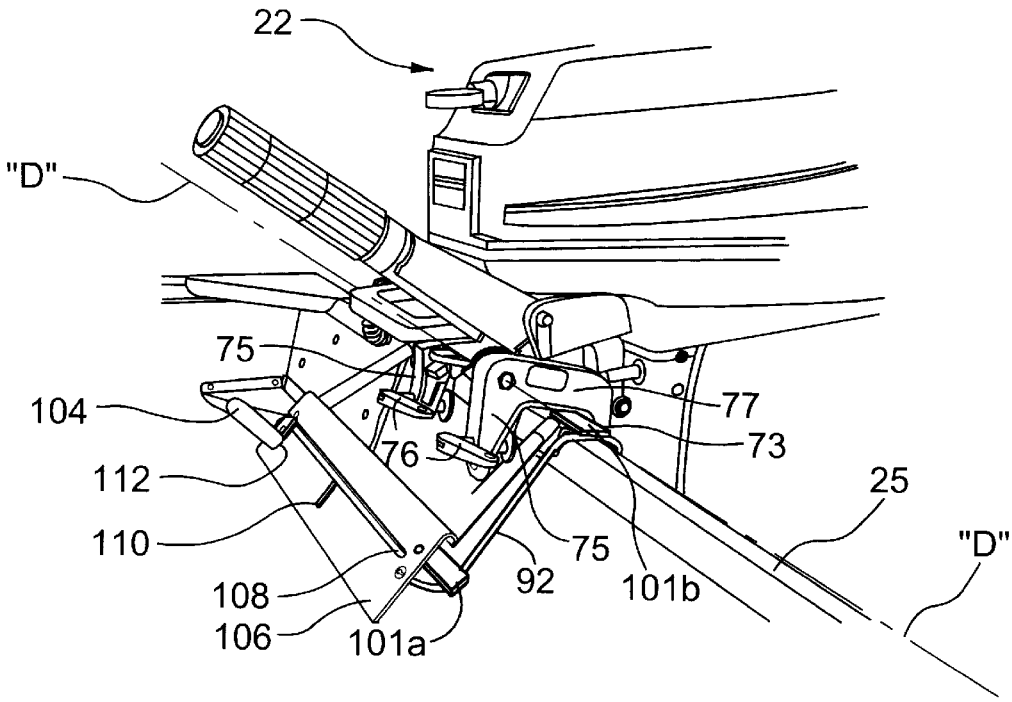
FIG. 9 is a front port side perspective view of the preferred embodiment of FIG. 3, showing the control handle positioned in the leg up notch.
Figure 10:
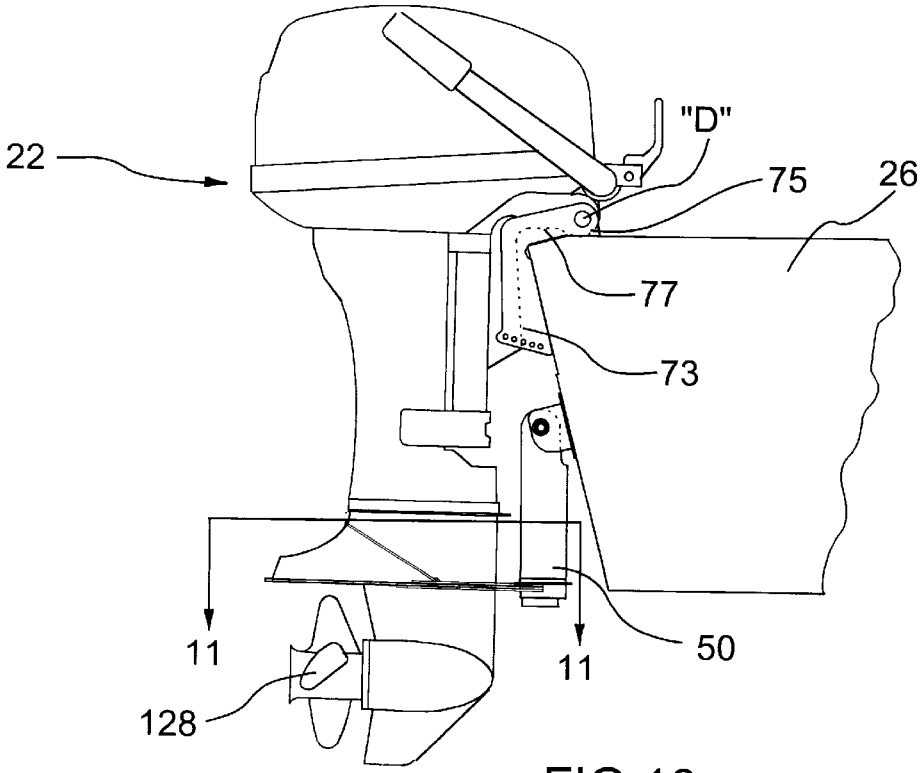
FIG. 10 is a starboard side elevational view, similar to FIG. 8, showing the telescopic leg member assembly in its fully retracted configuration.

FIGS. 6 through 10 best illustrate that the outboard motor protection apparatus 20 of the invention further preferably comprises a retracting means 90 for controlled retraction of the lower end segment 48 relative to the intermediate leg segment 49 and the upper end segment 50. The retracting means 90 comprises a Bowden cable 92, and a control member 96. The Bowden cable 92 of the retracting means 90 has a first and a second end, 98 and 100 respectively, the first end 98 of which passes within the leg member 30 through an aperture 63 in its upper end portion 40, and then passes through an aperture 64 in the lower holding plate 87 located within the lower end segment 48. After passing through the aperture 64 in the lower holding plate 87, an anchor portion 66 is secured and affixed to the first end 98 of the Bowden cable 92, the anchor portion 66 being of sufficient cross-sectional area to prevent passage through the aperture 64 in the lower holding plate 87. In this manner, the first end 98 of the Bowden cable 92 is operatively connected to the lower end segment 48. The second end 100 of the Bowden cable 92 is connected to a control handle 104 of the control member 96. The intervening length of the Bowden cable 92 is secured and affixed to the mounting means 28 and to a notched control panel 106 of the control member 96 by way of three clips 101*a*, 101*b*, and 101*c*. The control member 96 comprises the control handle 104, the notched control panel 106, and two control member arms 97*a*, 97*b*. The notched control panel 106 of the retracting means 90 is fixedly connected to the "C"-shaped flange member 60 of the mounting means 28 by way of the two control member arms, 97*a* and 97*b*, each extending therebetween from either lateral side thereof (as best seen in FIGS. 2, 6, 7, and 9). The notched control panel 106 accepts the control handle 104 in three discrete positions, namely, positioned in a leg down notch 108, positioned in an intermediate leg notch 110, and positioned in a leg up notch 112. The connection of the Bowden cable 92 to both the control handle 104 and the lower end segment 48 of the leg member 30 is such that the positioning of the control handle 104 in each of the three different notches 108, 110, and 112 in the notched control panel 106 corresponds to a different amount of retraction of the lower end segment 48, between the fully extended configuration (as discussed above and as shown, for example, in FIG. 8) and a fully retracted configuration (as shown in FIG. 10). The term "fully retracted configuration" means, in this specification and claims, the position of the telescopic leg member assembly 51 whereat both of the upper stop lips 70*a*, 70*b*, of the intermediate leg segment 49 and of the lower end segment 48 respectively, are in immediate downwardly adjacent relation to the upper holding plate 89 of the upper end segment 50.

FIGS. 7 and 8 respectively show the control handle 104 positioned in the leg down notch 108, and the telescopic leg member assembly 51 in the fully extended configuration.

FIGS. 9 and 10 respectively show the control handle 104 positioned in the leg up notch 112, and the telescopic leg member assembly 51 in the fully retracted configuration.

Figure 3:
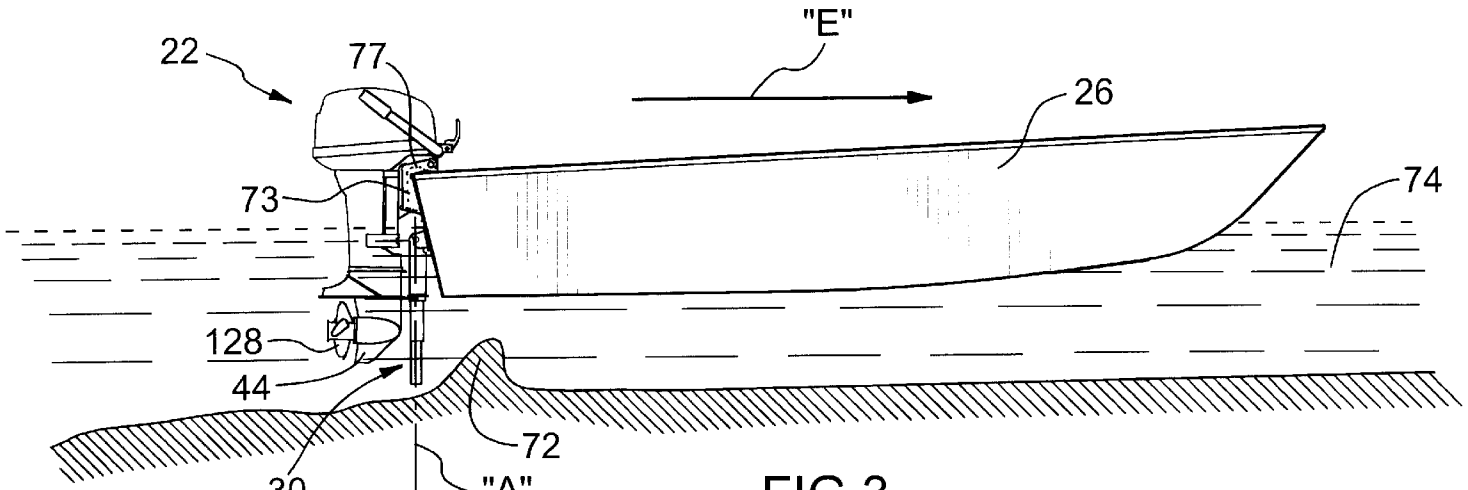
FIG. 3 is a starboard side elevational view of the outboard motor protection apparatus of FIG. 1, mounted as in FIG. 1, with the outboard motor shown in a drive configuration and with the boat travelling toward an underwater obstruction (shown in section).
Figure 4:
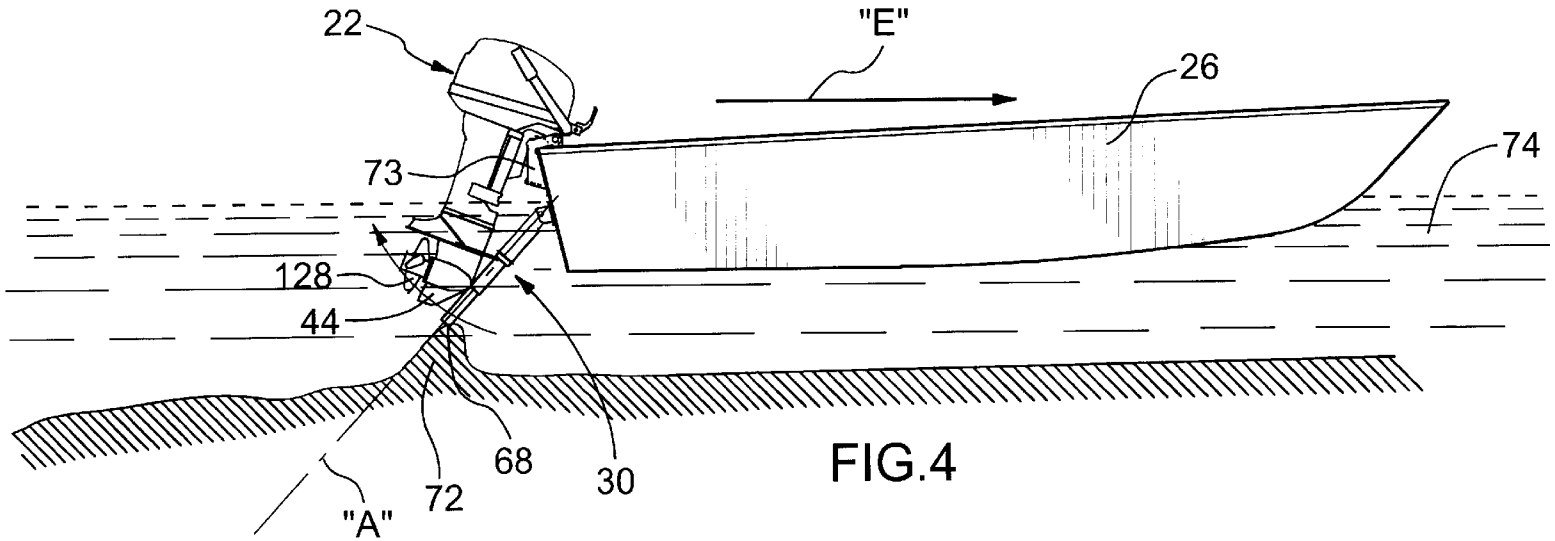
FIG. 4 is a starboard side elevational view similar to FIG. 3 wherein the apparatus is encountering an underwater obstruction (shown in section).
Figure 5:
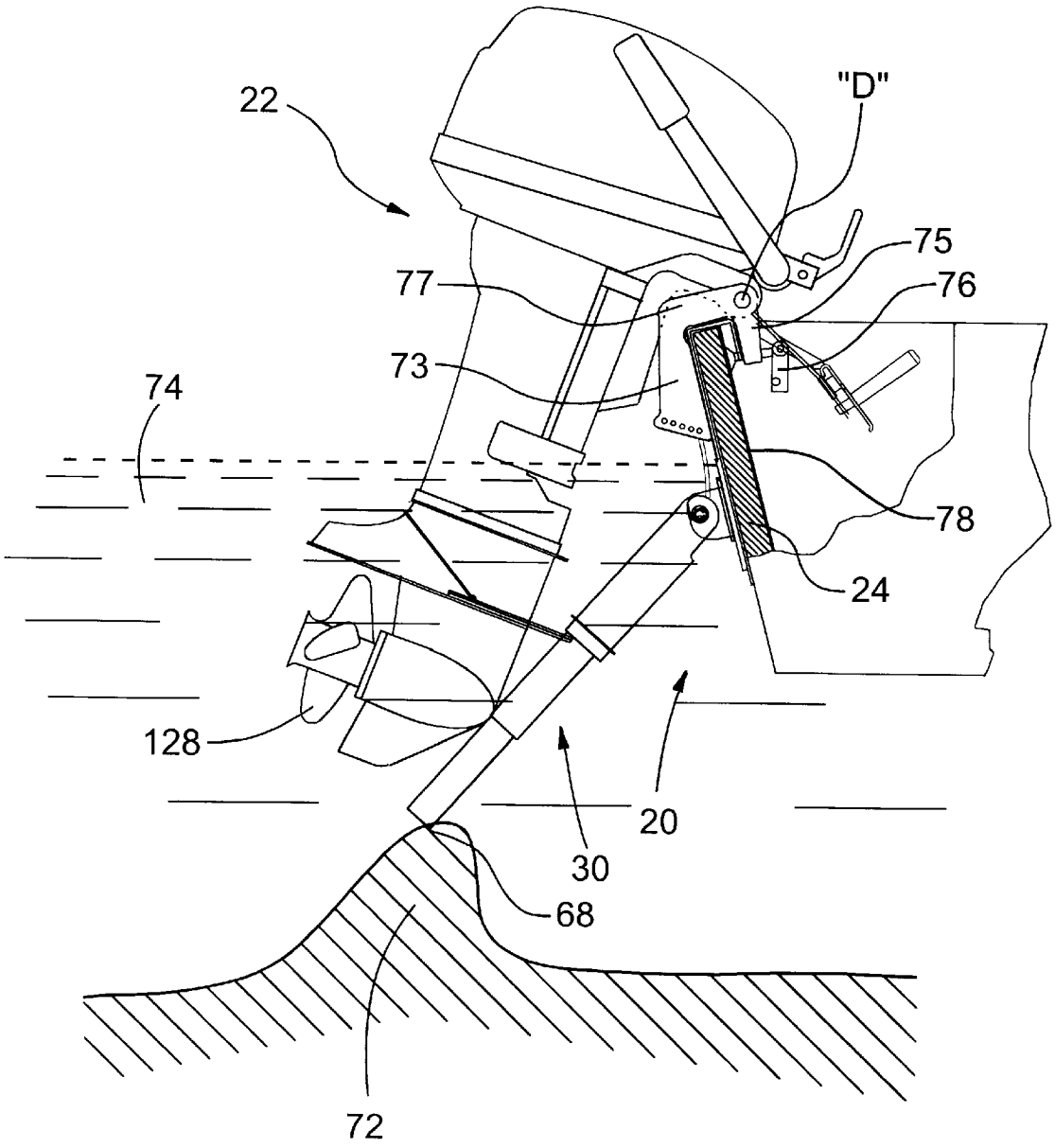
FIG. 5 is a starboard side elevational view of a stern section of the outboard motor and the boat of FIG. 4, with a portion of the boat hull cut away to better illustrate the manner of mounting of the preferred embodiment of the outboard motor protection apparatus on the transom of the boat in overhanging relation thereto.

With specific reference to FIGS. 3 and 4, it can be seen that, in use, as the leg member 30 encounters an underwater obstruction 72, the leg member 30 moves pivotally about the pivot pin 37 between the rest position, whereat the longitudinal leg axis "A" is substantially vertically disposed, and a plurality of active positions, (one of which is shown in FIG. 4) at which active position the longitudinal leg axis "A" is removed from the rest position, so as to place the leg member 30 in operative contact with the outboard motor 22, as described more fully below. The term "active position", in this specification and claims, means any position wherein the longitudinal leg axis "A" is displaced from the rest position as illustrated and previously defined, in a rearward direction toward the drive shaft portion 52 of the propeller mounting housing 56 of the outboard motor 22. In use, the leg member 30 is, in both its rest position and its active positions, operatively positioned in leadingly adjacent relation to the skeg portion 44 of the outboard motor 22. As such, when the leg member 30 encounters an underwater obstruction 72 as a result of the forward motion of the boat 26 (in the direction of arrow "E" of FIGS. 3 and 4), the leg member 30 moves from the rest position (as shown in FIG. 3) to one of the plurality of active positions (as shown in FIG. 4), so as to make operative contact with the leg contact surface 118 of the bumper member 34, thereafter to cause pivotal movement of the unlocked outboard motor 22 from the drive configuration (as shown in FIG. 3) to a raised configuration (as shown in FIG. 4). In this manner, the outboard motor 22 avoids direct impact with the underwater obstruction 72 so as to be protected from damage through such direct impact. That is, an outboard motor on a boat not so equipped with an outboard motor protection apparatus 20 according to the present invention, upon encountering such an underwater obstruction 72, would receive the full force of a direct impact with the underwater obstruction 72 in an uncontrolled and totally unpredictable manner, with the result being the infliction of potentially serious and costly damage to the propeller 128, to the outboard motor 22, and possibly even to the transom 24 of such a boat 26. In contrast, the boat 26 of FIGS. 3 and 4, on which the outboard motor protection apparatus 20 of the present invention is mounted, is protected from damage through such direct impact. Upon encountering the underwater obstruction 72, the leg member 30 of the outboard motor protection apparatus 20 itself receives the direct impact from the underwater obstruction 72 in a controlled manner designed to better absorb the kinetic energy of the impact, and, as a result of the continued forward motion of the boat 26 in the direction of arrow "E", the leg member 30 pivots about the pivot pin 37 into one of the plurality of active positions and into operative contact with the outboard motor 22. The manner of such contact is not only controlled to a greater degree, but, when the preferred bumper member 34 is positioned on the outboard motor as aforesaid, the leg contact surface 118 of the bumper member 34 provides a locus for controlled operative contact with the leg member 30 upon pivotal movement of the leg member 30 from its rest position. Further, the bumper member 34, being preferably constructed from a resilient plastics material having shock absorption qualities, helps to cushion any forces which may ultimately be indirectly transferred to the casing of the outboard motor 22 from the underwater obstruction 72. Moreover, the most vulnerable component of the outboard motor 22, being the propeller 128, is substantially always spared damaging contact with the underwater obstruction 72.

As the boat 26 continues to move over the underwater obstruction 72, and as the underwater obstruction 72 continues to exert force upon the leg member 30 in the rearward direction, the leg member 30 pivots incrementally about the pivot pin 37, through a plurality of active positions. Thereby, and through the operative contact of the leg member 30 with the bumper member 34, the leg member 30 exerts rearwardly directed force upon the bumper member 34 mounted on the outboard motor 22. The unlocked outboard motor 22 is thus itself caused to move pivotally, about its substantially horizontal tilt axis "D" in the direction of arrow "H", from the drive configuration (as shown in FIG. 3) to a corresponding raised configuration (as shown in FIG. 4), thus converting a portion of the kinetic energy generated by the impact into non-destructive pivotal movement. As the boat 26 continues to move forward over the underwater obstruction 72, the leg member 30 continues to pivot about the pivot pin 37 and the outboard motor continues to pivot about the horizontal tilt axis "D" in the direction of arrow "H", until a lowermost point 68 of the leg member 30 is raised to a level sufficient to clear the underwater obstruction 72 completely. The boat 26, the outboard motor protection apparatus 20, and the outboard motor 22 then pass freely beyond the underwater obstruction 72, with the outboard motor 22 having been protected from substantial impact damage which might otherwise have been caused by a direct impact with the underwater obstruction 72.

In use, another aspect of the invention, the retracting means 90, may be employed to adjust the telescopic leg member assembly 51 of the outboard motor protection apparatus 20 to various depths, by moving the control handle 104 from one of the notches 108, 110, 112 on the notched control panel 106 to another. The adjustable nature of the apparatus 20 is preferably such as to assist in protecting the outboard motor 22 from direct impact with underwater obstructions 72 located at varying depths below the surface of the water 74 through which the boat 26 is moving. Furthermore, the fully retracted configuration (as shown in FIG. 10) finds practical application when the boat 26 equipped with the telescopic leg member assembly 51 is travelling at high speeds in waters known to be free of underwater obstructions, as this configuration for the telescopic leg member assembly 51 creates less drag than either the fully extended configuration (as shown, for example, in FIG. 8) or an intermediate length configuration (not shown).

FIGS. 14 through 17 illustrate an alternate embodiment of the invention that differs from the preferred embodiment in that, in place of the telescopic leg member assembly 51, there is provided an alternate leg member 30' of constant length that reaches to a level below the skeg portion 44 of the outboard motor 22, and which has two weed cutting blades 122, 124 connected at its lower end portion 42'. The two weed cutting blades 122, 124 extend in opposite lateral directions, being substantially toward a starboard side (i.e., in the direction of arrow "I" of FIGS. 14 and 15) and toward a port side (i.e., in the direction of arrow "J" of FIGS. 14 and 15) of the boat 26, and in generally transverse relation to longitudinal leg axis "K" (defined, in an analogous manner to longitudinal leg axis "A" of the preferred embodiment, as extending between the lower end portion 42' and an upper end portion 40' of the alternate leg member 30') and to the forward direction indicated by arrow "E" of FIGS. 16 and 17. It is to be noted that, in FIGS. 14 through 17, the same reference numerals have been used to indicate objects, surfaces, components, and directions which are common to both the preferred embodiment and the alternate embodiment. It should also be noted that in the alternate embodiment, as the alternate leg member 30' is of constant length, there is no need for, nor is there provided, the retracting means 90 of the preferred embodiment. The alternate leg member 30' is, however, pivotally mounted on the base plate member 36 in the same general manner as is the leg member 30 of the preferred embodiment.

Figure 16:
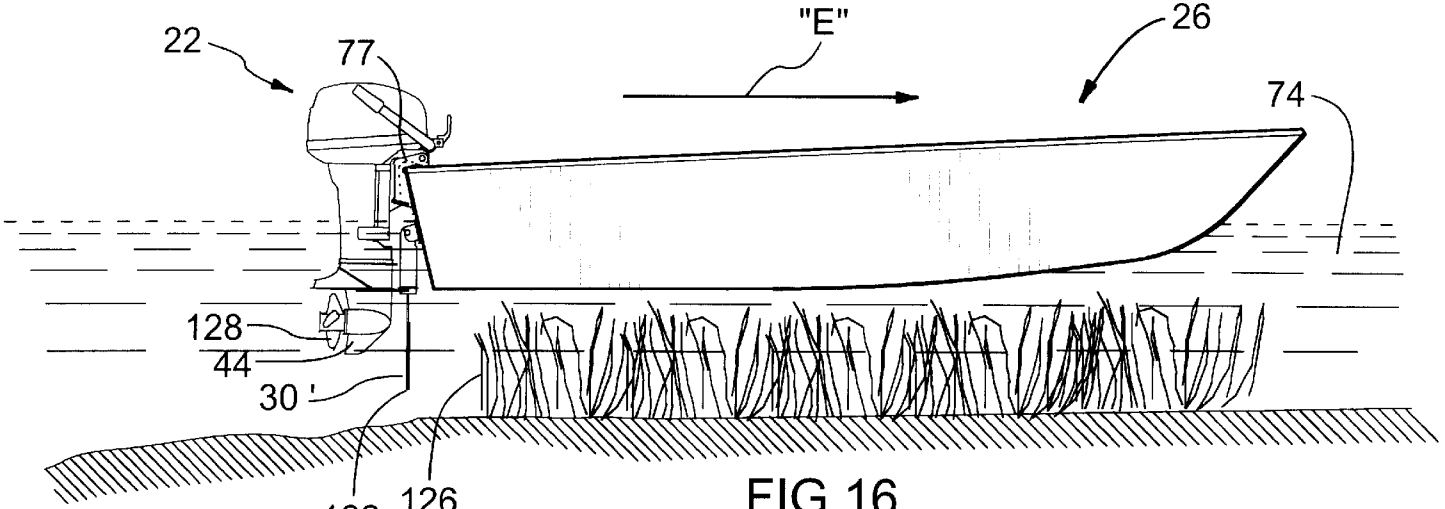
FIG. 16 is a starboard side elevational view of the outboard motor, the boat, and the alternate embodiment of the outboard motor protection apparatus of FIGS. 14 and 15, shown as the boat moves toward underwater weeds.
Figure 17:
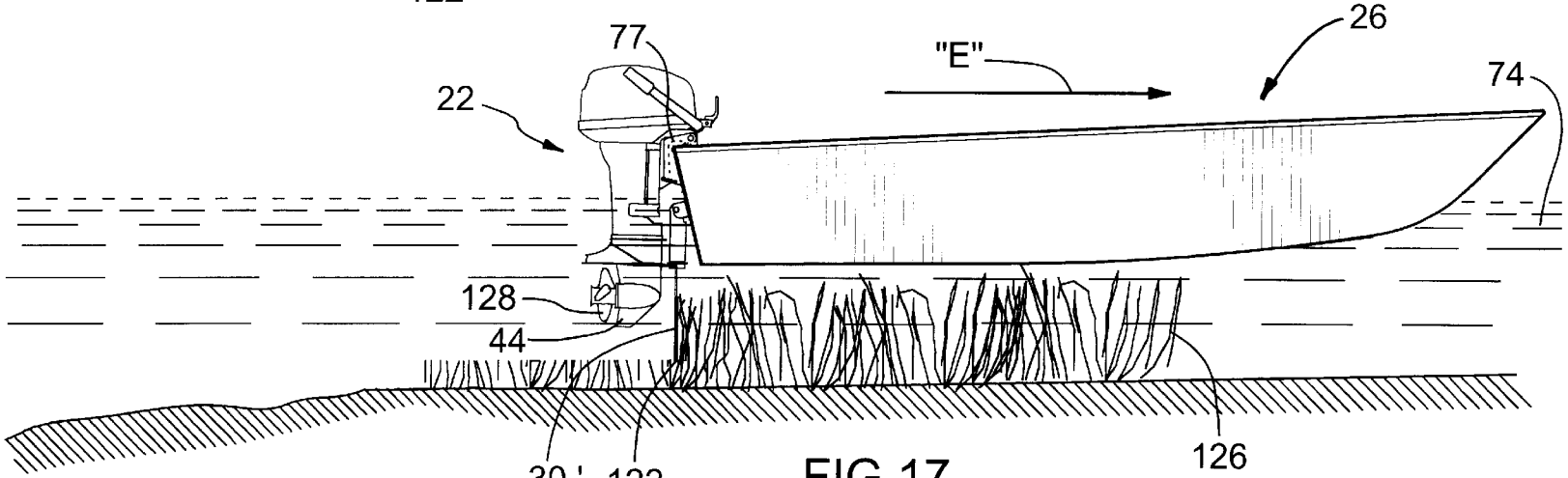
FIG. 17 is a starboard side elevational view similar to FIG. 16, wherein the alternate embodiment of the outboard motor protection apparatus is shown encountering underwater weeds.

FIGS. 16 and 17 show the alternate leg member 30' in use. The positioning and mounting of the alternate leg member 30' and the sharpness of the two weed cutting blades 122, 124 are preferably such that, when underwater weeds 126 are encountered as a result of the forward motion of the boat 26 in the direction of arrow "E" through the natural body of water 74, the blades 122 and 124 cut the weeds 126 at a distance below the skeg portion 44 of the outboard motor 22. In this manner, the weed cutting blades 122, 124 of the alternate leg member 30' preferably clear a path ahead of the propeller 128 of the outboard motor 22 and, thereby, assist in preventing the propeller 128 from becoming entangled underwater weeds 126. It should be pointed out that the force exerted by the underwater weeds 126 on the alternate leg member 30' is preferably not sufficient to cause the alternate leg member 30' to pivot about the pivot pin 37, but rather, the force is only sufficient to cause the underwater weeds 126 to be cut by the sharp weed cutting blades 122, 124. However, if the alternate leg member 30' encounters an underwater obstacle (not shown) that exerts a sufficient rearwardly directed force thereon, the alternate leg member 30' is caused to pivot in the same general manner as would the leg member 30 of the preferred embodiment in the same situation, and it, in turn, causes the outboard motor 22 to similarly pivot from the drive configuration to a raised configuration, as described above with reference to the preferred embodiment, and FIGS. 3 and 4.

Turning briefly to the materials from which the main components of the invention may be constructed, in both of the embodiments discussed above, the base plate member 36, the flange member 60, and the discrete lip member portions, 62*a* and 62*b*, are each preferably constructed from a non-resilient, rigid plastics material, such as ABS or polycarbonate plastics materials. Also common to both of the embodiments discussed above is the fact that the bumper member 34 is preferably constructed from a resilient plastics material having shock absorption qualities selected from the group consisting of rubber, synthetic rubber, nylon, and filled nylon. In the preferred embodiment, the upper end segment 50, the intermediate leg segment 49, and the lower end segment 48 are each preferably constructed from a non-resilient, rigid plastics material. Similarly, in the alternate embodiment discussed above, the alternate leg member 30' is preferably constructed from a non-resilient, rigid plastics material, excepting its two weed cutting blades, 122 and 124, connected at the lower end portion 42' thereof, which are instead preferably of metal construction.

It will be understood that the invention is not to be limited to the exact construction shown and described, but that various changes and modifications may be made without departing from the spirit and scope of the invention as described in the appended claims. For example, one obvious such change would be to combine a weed cutting blade (not shown, but of the general type described and enumerated by reference numerals 122 and 124) with the telescopic leg member assembly 51 of the preferred embodiment.

I claim:

1. An outboard motor protection apparatus interposable between an outboard motor having a downwardly depending propeller mounting housing terminating in a skeg portion, and a transom of a boat upon which the outboard motor is to be mounted for pivotal movement of the motor relative to the transom about a first substantially horizontal tilt axis between a drive configuration and a raised configuration, said apparatus comprising:

a) means for removably mounting said apparatus onto the transom of the boat in said interposed relation with a base plate member extending downwardly in juxtaposed relation to a trailing face of the transom;

b) a leg member having an upper end portion and a lower end portion and defining a longitudinal leg axis extending therebetween, said leg member being operatively positioned in leadingly adjacent relation to said skeg portion, said leg member being mounted adjacent said upper end portion on said base plate for pivotal movement of the leg member in a plane substantially transverse to the base plate about a second substantially horizontal tilt axis positioned below the level of said first substantially horizontal tilt axis, between a rest position, whereat said leg axis is substantially vertically disposed, and a plurality of active positions, whereat said leg axis is removed from said rest position so as to place said leg member in operative contact with the outboard motor below the level of said first substantially horizontal tilt axis, such that, when said leg member encounters an underwater obstruction as a result of the forward motion of the boat through a body of water, said leg member pivotally moves as aforesaid from said rest position to one of said plurality of active positions so as to cause said pivotal movement of the outboard motor from said drive configuration to said raised configuration, whereby the outboard motor avoids impact with the underwater obstruction so as to be protected from damage through such impact.

2. An outboard motor protection apparatus according to claim 1, wherein said means for mounting said apparatus onto the transom of the boat is further adapted to mount said apparatus on said transom in overhanging relation thereto.

3. An outboard motor protection apparatus according to claim 2, wherein said means for removably mounting said apparatus onto the transom of the boat comprises an inverted "U"-shaped hook portion having a first arm formed by an upper extent of said base plate member, and a second arm formed by a downwardly projecting lip member, said lip member being connected to the first arm by a flange member adapted to overlie an upper free edge of said transom.

4. An outboard motor protection apparatus according to claim 3, wherein said lip member is bifurcated to form two discrete laterally spaced lip member portions, said flange member and said lip member portions being together dimensioned and otherwise adapted to allow mounting clamps of the outboard motor to bear directly upon a leading face of the transom of the boat when said outboard motor is mounted upon the boat.

5. An outboard motor protection apparatus according to claim 4, wherein said base plate member, said flange member, and said lip member portions each have a respective bearing surface on their respective undersides for contacting the transom of the boat, and wherein each said bearing surface has a resilient cushioning layer applied thereover.

6. An outboard motor protection apparatus according to claim 5, wherein said resilient cushioning layer on each said bearing surface is constructed from synthetic rubber.

7. An outboard motor protection apparatus according to claim 6, wherein said leg member further comprises a horizontally disposed vortex blocking flange positioned on said leg member in substantially surrounding relation thereto, so as to be positioned below the surface of the water when the apparatus is mounted on the transom of the boat as aforesaid and when said leg member is in its rest position.

8. An outboard motor protection apparatus according to claim 7, further comprising a bumper member, having a motor mounting surface and a leg contact surface, said bumper member being mountable on said downwardly depending propeller mounting housing in interposed relation between said outboard motor and said leg member, when in use, so as to present said leg contact surface as a locus for said operative contact with the outboard motor upon said pivotal movement of the leg member from said rest position.

9. An outboard motor protection apparatus according to claim 8, wherein, when in use, said bumper member further comprises a horizontally disposed finned portion which projects leadingly forward in partially surrounding, non-contacting relation to said leg member in its rest position.

10. An outboard motor protection apparatus according to claim 9, further comprising a resilient strap member, removably connected to said bumper member at either end of said motor mounting surface so as to stretch over a trailing surface of the propeller mounting housing of the outboard motor when the bumper member is mounted on the downwardly depending propeller mounting housing.

11. An outboard motor protection apparatus according to claim 10, wherein said leg contact surface of said bumper member is substantially "V"-shaped.

12. An outboard motor protection apparatus according to claim 11, wherein said leg member extends below the level of the skeg portion of the outboard motor, and wherein said leg member further comprises a substantially horizontally disposed weed cutting blade connected in generally transverse axial relation to the lower end portion of said leg member.

13. An outboard motor protection apparatus according to claim 12, wherein two of said weed cutting blades are provided so as to operatively extend, one each, in opposite lateral directions from said lower end portion of the leg member toward a starboard side and toward a port side of said boat.

14. An outboard motor protection apparatus according to claim 11, wherein said upper end portion of the leg member is formed by a discrete upper end segment, and said lower end portion of the leg member is formed by a discrete lower end segment, with said upper and lower end segments being interconnected to one another by means of one or more discretely formed intermediate leg segments slidably mounted one within the other, with an uppermost of said intermediate leg segments being slidably mounted within said upper end segment, and said lower end segment being slidably mounted within a lowermost of said intermediate leg segments, thereby to together form a telescopic leg member assembly.

15. An outboard motor protection apparatus according to claim 14, further comprising a biasing means interconnected between said upper and lower end segments of said leg member so as to bias said leg member toward a fully extended configuration.

16. An outboard motor protection apparatus according to claim 15, wherein said biasing means is a coil spring.

17. An outboard motor protection apparatus according to claim 16, further comprising a retracting means for controlled retraction of said lower end segment relative to said intermediate leg segments and said upper end segment of said leg member against said biasing by said biasing means, said retracting means comprising:

a) a Bowden cable, having a first end and a second end, said first end of said Bowden cable being operatively connected within said leg member to said lower end segment of said leg member; and b) a control means connected to said second end of said Bowden cable.

18. An outboard motor protection apparatus according to claim 17, wherein said control means comprises:

a) a control handle, connected to said second end of said Bowden cable; and b) a notched control panel which accepts said control handle in a plurality of positions, whereby each of said plurality of positions corresponds to a different degree of said retraction of said lower end segment of said leg member by said Bowden cable.

19. An outboard motor protection apparatus according to claim 18, wherein said upper end segment, said one or more intermediate leg segments, and said lower end segment are each constructed from a non-resilient, rigid plastics material.

20. An outboard motor protection apparatus according to claim 19, wherein said base plate member, said flange member, and said lip member portions are each constructed from a non-resilient, rigid plastics material.

21. An outboard motor protection apparatus according to claim 20, wherein said bumper member is constructed from a resilient plastics material having shock absorption qualities selected from the group consisting of rubber, synthetic rubber, nylon, and filled nylon.

* * * * *